United States Patent [19]

Ooms

[11] 4,422,949

[45] Dec. 27, 1983

[54] TEXTILE TREATMENT COMPOSITIONS AND PREPARATION THEREOF

[75] Inventor: Julius Ooms, Langdorp, Belgium

[73] Assignee: The Procter & Gamble Company, Cincinnati, Ohio

[21] Appl. No.: 354,280

[22] Filed: Mar. 3, 1982

[30] Foreign Application Priority Data

Mar. 7, 1981 [GB] United Kingdom ..... 8107236

[51] Int. Cl.[3] ..... D06M 13/20; D06M 13/46

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 4,126,562 | 11/1978 | Goffinet et al. | 252/8.8 |
| 4,149,987 | 4/1979 | Goffinet | 252/8.8 |
| 4,155,855 | 5/1979 | Goffinet et al. | 252/8.8 |
| 4,233,164 | 11/1980 | Davis | 252/8.8 |
| 4,320,013 | 3/1982 | Lohman | 252/8.8 |
| 4,399,043 | 8/1983 | Keil et al. | 252/8.8 |

FOREIGN PATENT DOCUMENTS

| | | | |
|---|---|---|---|
| 13780 | 8/1980 | European Pat. Off. . | |
| 18039 | 10/1980 | European Pat. Off. . | |
| 2393060 | 12/1978 | France . | |
| 2393100 | 12/1978 | France . | |
| 1550205 | 8/1979 | United Kingdom . | |
| 1550206 | 8/1979 | United Kingdom . | |
| 1601360 | 10/1981 | United Kingdom | 252/8.8 |

*Primary Examiner*—Maria Parrish Tungol

*Attorney, Agent, or Firm*—Richard C. Witte; Ronald L. Hemingway

[57] ABSTRACT

Concentrated textile treatment compositions suitable for use in the rinse cycle of a textile laundering operation containing from 12% to 25% of an active mixture comprising a water-insoluble quaternary ammonium fabric softener, a water-soluble alkoxylated ammonium surfactant and a fatty acid ester of a polyhydric alcohol. The compositions are stable dispersions displaying excellent viscosity characteristics at both low and high temperature over prolonged periods of storage.

14 Claims, No Drawings

TEXTILE TREATMENT COMPOSITIONS AND PREPARATION THEREOF

FIELD OF THE INVENTION

The present invention relates to textile treatment compositions and their preparation. In particular, it relates to concentrated textile treatment compositions suitable for use in the rinse cycle of a textile laundering operation to provide fabric softening/static control benefits, the compositions being characterized by excellent storage stability and viscosity characteristcis after prolonged storage at both normal and elevated temperatures.

BACKGROUND OF THE INVENTION

Textile treatment compositions suitable for providing fabric softening and static control benefits during laundering are well-known in the art and have found wide-scale commercial application. Conventionally, rinse-added fabric softening compositions contain, as the active softening component, substantially water-insoluble cationic materials having two long alkyl chains. Typical of such materials are di-stearyl di-methyl ammonium chloride and imidazolinium compounds substituted with two stearyl groups. These materials are normally prepared in the form of a dispersion in water and it is generally not possible to prepare such aqueous dispersions with more than about 10% of softening material without encountering intractible problems of product viscosity and stability, especially after storage at elevated temperatures, such that the compositions are unpourable and have inadequate dispensing and dissolving characteristics in rinse water. This physical restriction on softener concentration naturally limits the level of softening performance achievable without using excessive amounts of product, and also adds substantially to the costs of distribution and packaging. Accordingly, it would be highly desirable to prepare physically-acceptable textile treatment compositions containing much higher levels of water-insoluble cationic softener materials.

THE PRIOR ART

The problem of preparing fabric softening compositions in concentrated form suitable for consumer use has already been addressed in the art, but the various solutions have not been entirely satisfactory. It is generally known (for example in U.S. Pat. No. 3,681,241) that the presence of ionizable salts in softener compositions does help reduce viscosity, but this approach is ineffective in compositions containing more than about 12% of dispersed softener, in as much as the level of ionizable salts necessary to reduce viscosity to any substantial degree has a seriously detrimental effect on product stability.

In European Published Patent Application No. 406 concentrated fabric softeners are disclosed which comprise three active softening ingredients, one of which is a highly soluble cationic fabric substantive agent. While such compositions do allow a high concentration of active ingredient, their overall softening performance is less effective than is the case with compositions containing predominantly a water-insoluble cationic softener. In European Patent Application No. 13780, the use of low levels of paraffinic hydrocarbons, fatty acids, fatty acid esters and fatty alcohols as viscosity control agents for concentrated softener compositions is described. It has been found, however, that although these materials are excellent in reducing the viscosity of concentrated fabric softener compositions at temperatures below the Krafft point of the cationic sosftener, they are very much less effective as viscosity reducing agents at temperatures close to or above the Krafft point of the softener, or over extended storage periods.

It has now been discovered that viscosity control in concentrated fabric softener compositions can be significantly improved, both at normal and higher temperatures, without detrimentally effecting product stability, by the addition thereto of defined levels of certain water-soluble surfactants together with a defined level of a fatty acid ester of a polyhydric alcohol. While the use of water-soluble surfactants and fatty acid esters in softener compositions is not new (see, for instance, British Pat. Nos. 1,550,205 and 1,550,206 and European patent Application No. 18039), it appears that the value of the specific combination of additive materials disclosed herein for controlling the high temperature and long term viscosity and stability of concentrated softener compositions, has hitherto not been recognized in the art.

SUMMARY OF THE INVENTION

The present invention thus provides a concentrated aqueous textile treatment composition having improved viscosity characteristics at both normal and elevated temperatures and over prolonged storage periods and having good storage stability and other physical characteristics necessary for consumer use. The present invention also provides a cost-efficient, physically-acceptable concentrated textile treatment composition providing softening and anti-static benefits across the range of natural and synthetic fabric types, based on water-insoluble cationic softener as the major active component of the composition.

Accordingly, the present invention provides an aqueous textile treatment composition characterized by from about 12% to about 25% of an active mixture consisting essentially of (a) from about 8% to about 22% of a substantially water-insoluble cationic fabric softener having the general formula I

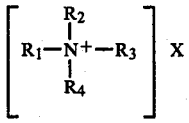

I wherein $R_1$ and $R_2$ are independently selected from the group consisting of alkyl and alkenyl groups having from about 12 to about 24 carbon atoms, $R_3$ and $R_4$ are independently selected from the group consisting of hydrogen, alkyl, alkenyl and hydroxyalkyl groups containing from about 1 to about 4 carbon atoms; and X is an equivalent amount of a counteranion, (b) from about 0.6% to about 3% of water-soluble surfactant comprising a polyalkoxylated ammonium salt having the general formula II

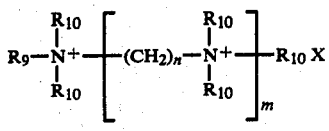

II wherein $R_9$ is selected from the group consisting of alkyl and alkenyl groups of from about 8 to about 22 carbon atoms, and each $R_{10}$ is independently selected from the group consisting of $C_1$–$C_4$ alkyl, $-(C_2H_4O)_pH$, $-(C_3H_6O)_qH$ and $-(C_2H_4O)_r(C_3H_6O)_sH$; wherein n is an integer from 2 to about 6; m is an integer from 1 to about 5; p,q,r,s, are each a number average in the range from 0 to about 14, the sum total of p,q,r, and s in the molecule being from 2 to about 14, and (c) from about 0.2% to about 5% of a fatty acid ester of a polyhydric alcohol, the ester having a total of from about 10 to about 40 carbon atoms and at least one free hydroxy group per molecule.

All percentages and ratios specified herein are given by weight of total composition, unless otherwise indicated.

DESCRIPTION OF THE INVENTION

The compositions of the invention thus contain an active mixture comprising at least three essential components, viz., a water-insoluble cationic softener, a water-soluble surfactant and a fatty acid ester of a polyhydric alcohol. This active mixture is employed at a level in the range from about 12% to about 25% with the water-insoluble cationic softener being employed at a level in the range from about 8% to about 22% by weight of composition. The lower limits are amounts needed to contribute effective fabric conditioning performance when added to laundry rinse baths at the reduced usage volumes envisaged in the practice of the invention. The upper limits are amounts beyond which physical instability problems increasingly arise on storage of the compositions.

The water-soluble surfactant comprises, as an essential component a polyalkoxylated ammonium salt having the general formula II. Preferred water-soluble surfactants, however comprise a mixture of the polyalkoxylated ammonium salt and a non-alkoxylated ammonium salt having the general formula III

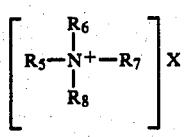

III wherein $R_5$ represents alkyl or alkenyl groups of from about 8 to about 24 carbon atoms; $R_6$, $R_7$, and $R_8$ represent an alkyl or alkenyl group containing from 1 to about 4 carbon atoms; and X is as defined above.

Especially preferred herein is a water-soluble cationic surfactant comprising a mixture of a non-alkoxylated ammonium salt and a polyalkoxylated ammonium salt in a weight ratio of from about 10:1 to about 1:6, more especially from about 3:1 to about 1:2.

The water-soluble surfactant preferably comprises from about 1.4% to about 2.5% by weight of the composition. Moreover, the weight ratio of water-insoluble cationic fabric softener to water-soluble surfactant is preferably in the range from about 7:1 to about 4:1. Note that, depending on the precise pH of the formulation, at least a proportion of non-quaternary ammonium surfactant components of the composition may be present in deprotonated form. In respect of such compositions, all weight percentages and ratios herein are quoted in terms of the corresponding ammonium salt. The composition pH is generally from about 2 to about 7, preferably from about 2.5 to about 5, more preferably from about 3 to about 4.

The fatty acid ester component is preferably present at a level of about 1% to about 4% by weight of composition, a highly preferred composition thus comprising (a) from about 10% to about 18%, especially from about 11% to about 15% of the fabric softener of general formula I, (b) from about 0.4% to about 1.5%, especially from about 0.75% to about 1.25% of water-soluble cationic surfactant of general formula II, (c) from about 0.2% to about 2%, especially from about 0.2% to about 0.75% of water soluble surfactant of general formula III, and (d) from about 1% to about 4%, especially from about 2.0% to about 3.5% of the fatty acid ester.

An especially suitable fatty acid ester is glyceryl monostearate.

The present invention also provides a method of making the textile treatment compositions generally described above by the steps of:

(a) preparing a molten premix of the water-insoluble cationic fabric softener, fatty acid ester, and water-soluble surfactant, (b) intimately mixing the molten premix with an aqueous medium at a temperature above the melting point of the premix to form an aqueous dispersion, and (c) cooling the dispersion.

In the case of the dihydrogenated tallow dimethyl ammonium chloride softener, the melting and intimate mixing steps are preferably undertaken at a temperature in excess of about 37° C., more preferably in excess of about 45° C.

Alternatively, the water-soluble surfactant can be predissolved in the aqueous medium to form an aqueous surfactant solution, the molten premix of cationic fabric softener and fatty acid ester then being intimately mixed therewith.

The compositions of the invention preferably are stable to separation in a centrifuge at 3000 r.p.m. for 16 hours and have a dynamic viscosity in the range from about 350 cp (0.35 Pa.s) to about 70 cp (0.07 Pa.s), preferably from about 200 cp (0.2 Pa.s) to about 100 cp (0.1 Pa.s) measured in a Brookfield Viscometer, using Spindle No. 2 at 60 r.p.m. and at 21° C.

The water-insoluble cationic fabric softener is preferably a fabric-substantive cationic compound which, in pure form as a strong acid salt (e.g. chloride), has a solubility in distilled water at pH 2.5 and 20° C. of less than 1 g/l, or can be a mixture of such compounds. In this context, the soluble fraction of the surfactant is taken to be that material which cannot be separated from water by centrifugal action and which passes a 100 nm Nuclepore filter (Registered Trade Mark). In addition, the cationic softener desirably has a monomer solubility (as measured by critical micelle concentration or C.M.C.) such that the C.M.C. of the material under the conditions defined above is less than about 50 p.p.m, preferably less than about 20 p.p.m. Literature C.M.C. values are taken where possible, especially surface tension, conductimetric or dye adsorption values.

The substantially water-insoluble cationic fabric softeners are the quaternary ammonium and amine salt compounds having the formula:

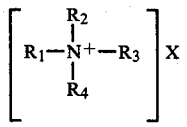

wherein $R_1$ and $R_2$ represent alkyl or alkenyl groups of from about 12 to about 24 carbon atoms, $R_3$ and $R_4$ represent hydrogen, alkyl, alkenyl or hydroxyalkyl groups containing from 1 to about 4 carbon atoms; and X is the salt counteranion, preferably selected from halide, methyl sulfate, ethyl sulfate, benzoate, acetate, propionate and phosphate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl anionic chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride, and di(coconut alkyl) dimethyl ammonium methosulfate. Of these ditallow dimethyl ammonium chloride and di(hydrogenated tallow alkyl) dimethyl ammonium chloride are preferred.

The water-soluble surfactant is preferably a cationic surfactant having a solubility in distilled water at pH 2.5 and 20° C. of greater than 1 g/l. Once again, the solubility of the cationic surfactant is defined with reference to the pure material in the form of a strong acid salt (eg chloride), and the soluble fraction of the surfactant is taken to be that material which cannot be separated from water by centrifugal action and which passes a 100 nm Nuclepore filter.

The water-soluble surfactant includes, as an essential component, alkoxylated ammonium materials having the general formula II

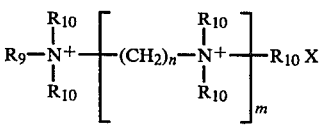

II wherein $R_9$ is an alkyl or alkenyl group of from about 8 to about 22 carbon atoms, and each $R_{10}$ independently represents a $C_1$–$C_4$ alkyl group $-(C_2H_4O)_pH$, $-(C_3H_6O)_qH$ or $-(C_2H_4O)_r(C_3H_6O)_sH$; wherein n is an integer from about 2 to about 6; m is an integer from 1 to about 5; p,q,r,s, are each a number average in the range from 0 to about 14, preferably 1 to about 11, more preferbly 1 to about 8, the sum total of p,q,r, and s in the molecule being from 2 to about 14, preferably from 2 to about 12. Preferred materials of this general type contain not more than one $-C_2H_4OH$ or $-C_3H_6OH$ group attached to each nitrogen atom, except that up to two of these groups can be attached to a terminal nitrogen atom which is not substituted by an alkyl group having from about 10 to about 24 carbon atoms. Highly preferred X counteranions are chloride and phosphate.

Polyalkoxylated ammonium species of formula II suitable for use herein include:

N-tallowyl-N,N',N'-tris(2-hydroxyethyl)-1,3-propanediamine dihydrochloride or dibenzoate;
N-stearyl-N,N'-di(2-hydroxyethyl)-N'-(3-hydroxypropyl)-1,3-propanediamine dihydrofluoride;
N-oleyl-N,N',N'-tris(3-hydroxypropyl)-1,3-propanediamine dihydrofluoride;
N-stearyl-N,N'N'-tris(2-hydroxyethyl)-N,N'-dimethyl-1,3-propanediammonium dimethylsulfate;
N-palmityl-N,N',N'-tris(3-hydroxypropyl)-1,3-propanediamine dihydrobromide;
N-(stearyloxypropyl)-N,N',N'-tris(3-hydroxypropyl)-1,3-propanediammonium diacetate; and
N-oleyl-N-[N'',N''-bis(2-hydroxyethyl)-3-aminopropyl]-N',N'-bis(2-hydroxyethyl)-1,3-diaminopropane trihydrofluoride.

The polyalkoxylated ammonium surfactants are preferably present in the admixture with water-soluble mono-ammonium compounds having the general formula III

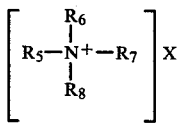

III wherein $R_5$ represents a $C_8$–$C_{24}$ alkyl or alkenyl group, $R_6$, $R_7$ and $R_8$ represent an alkyl or alkenyl group containing from 1 to about 4 carbon atoms; and wherein X is as defined above.

Highly preferred materials of this general type include the tallow trimethyl ammonium salts, cetyl trimethyl ammonium salts, myristyl trimethyl ammonium salts and coconutalkyl trimethyl ammonium salts.

It should be understood, of course, that water-soluble cationic surfactants of the amine-salt class can be added in the form of the neutral amine followed by pH adjustment to within the range from about pH 3.5 to about pH 7.

The fatty acid ester component of the present compositions has a total of from about 10 to about 40 carbon atoms and at least one free hydroxy group per molecule. Preferred materials of this type include $C_{10}$–$C_{24}$ fatty acid esters of polyhydroxy alcohols containing from 2 to about 12 carbon atoms.

The polyhydric alcohol portion of the ester can be represented by ethylene glycol and polyethylene glycol with a maximum of 5 ethylene glycol units, glycerol, diglycerol, polyglycerol, xylitol, erythritol, pentaerythritol, sorbitol or sorbitan, sugars such as glucose, fructose, galactose, mannose, xylose, arabinose, ribose, 2-deoxy-ribose, sedoheptulose and sucrose. Ethylene glycol, glycerol, and sorbitan esters are particularly preferred, especially the monoesters of glycerol.

The fatty acid portion of the ester normally comprises a fatty acid having from about 10 to about 24 (preferably about 12 to about 22) carbon atoms, typical examples being lauric acid, myristic acid, palmitic acid, stearic acid, arachidic acid, behenic acid, oleic acid and linoleic acid.

The glycerol esters are very highly preferred. These are the mono-, di- or tri-esters of glycerol and fatty acids of the class described above. Commercial glyceryl mono-stearate, which may contain a proportion of di- and tri-stearate, is suitable. Also useful are mixtures of saturated and unsaturated esters of glycerol derived from mixed saturated and unsaturated fatty acids.

Another suitable group of nonionic fabric conditioning agents are the $C_{10}$ to $C_{24}$ fatty acid esters of sorbitan such as those described in Murphy et al., U.S. Pat. No. 4,085,052 issued Apr. 18, 1978 incorporated herein by reference. Sorbitan mono- and di-esters of lauric, myristic, palmitic, stearic, arachidic or behenic, oleic or linoleic acids are particularly useful as softening agents and can also provide antistatic benefitss. Sorbitan esters are commercially available, for instance, under the trade name Span. For the purpose of the present invention, it is preferred that a significant amount of di- and tri-sorbitan esters are present in the ester mixture. Ester mixtures having from about 20% to about 50% monoester, about 25% to about 50% di-ester and about 10% to about 35% of tri- and tetra-esters are preferred.

In addition to the cationic softener, water-soluble surfactant and fatty acid ester components, the present compositions can be supplemented by all manner of optional components conventionally used in textile treatment compositions, for example, colorants, perfumes, preservatives, optical brighteners, opacifiers, pH buffers, viscosity modifiers, fabric conditioning agents, surfactants, stabilizers such as guar gum and polyethylene glycol, anti-shrinkage agents, anti-wrinkle agents, fabric crisping agents, nonionic softening agents, spotting agents, soil-release agents, germicides, fungicides, anti-oxidants such as butylated hydroxy toluene, anti-corrosion agents etc. Of course, the level of these optional ingredients should, if necessary, be controlled so as not to deleteriously effect the physical stability and viscosity characteristics of the product.

Additional viscosity control agents suitable for use in the present compositions include electrolytes such as calcium chloride, magnesium chloride, magnesium sulfate, sodium chloride etc, which can be added either to the premix or to the final softener dispersion at levels in the range from about 50 to 1500, preferably from 600 to 1000 parts per million, and lower alcohols such as ethanol, isopropanol, propanediol, ethylene glycol, hexylene glycol and butanol added at levels up to about 10% of composition. Particularly preferred is isopropanol at a level from about 0.2% to about 4%, especially about 0.5% to about 2% of composition, the weight ratio of cationic fabric softener to isopropanol preferably lying in the range from about 50:1 to about 6:1, more preferably from about 25:1 to about 12:1. A preferred additional phase stabilizer material is a polyethyleneglycol having a molecular weight in the range from about 1000 to about 40,000, especially from about 4000 to about 15,000, and comprising from about 0.1% to about 5%, preferably from about 0.3% to about 2% by weight of composition.

The compositions of the invention can optionally include tri-$C_{12}$–$C_{24}$ quaternary ammonium softeners such as the trihardenedtallowalkylmethylammonium salts, the trioleylmethylammonium salts and the tripalmitylmethylammonium salts. Such materials can constitute from about 0.2% to about 2.5%, more preferably from about 0.5% to about 2% of the composition, and from about 2% to about 10%, more preferably from about 4% to about 8% of the total cationic softener.

In addition to the above-mentioned components, the compositions may contain other textile treatment or conditioning agents. Such agents include silicones, as for example described in German Patent Application DOS No. 26 31 419 incorporated herein by reference. The optional silicone component can be used in an amount of from about 0.1% to about 6%, preferably from about 0.2% to about 2% of the softener composition.

Another optional ingredient of the present compositions is a water-soluble cationic polymer having a molecular weight in the range from about 2000 to about 250,000, preferably from about 5000 to about 150,000 and containing an average of from about 100 to about 1000, preferably from about 150 to about 700 monomer units per molecule. Molecular weights are specified as viscosity average molecular weights and can be determined as described in F. Daniels et al Experimental Physical Chemistry, pp 71–74, 242–246, McGraw-Hill (1949), at 25° C. using an Ostwald viscometer. The polymers are preferably soluble in distilled water to the extent of 0.5% by weight at 20° C. Such polymers can provide valuable softening robustness in the presence of anionic surfactant caried over from a previous cleaning operation, and also contribute to viscosity control. Suitable polymers of this type include polyethyleneimine having an average molecular weight of from about 10,000 to about 35,000, ethoxylated polyethyleneimine wherein the weight ratio of polyethyleneimine to ethyleneoxide is at least 1:1 and wherein the molecular weight is from about 20,000 to about 70,000, and quaternized polyethyleneimines sold under the Trade Name Alcostat by Allied Colloids.

Suitable preservatives for use in the present compositions include 2-nitro-2-bromo-propane-1,3-diol, glutaraldehyde and 2-methyl-4-isothiazolin-3-one and its 5-chloro derivative.

The textile treatment compositions of the invention can be used by adding to the rinse cycle of a conventional, home laundry operation. Generally, rinse water has a temperature of from about 5° C. to about 60° C. The concentration of the total active ingredients is generally from about 2 ppm to about 1000 ppm, preferably from about 10 ppm to about 500 ppm, by weight of the aqueous rinsing bath.

In general, textile treatment comprises the steps of (a) washing fabrics in a conventional washing machine with a detergent composition; (b) rinsing the fabrics; (c) adding during the rinsing stage of the operation the above-described amounts of textile treatment composition active ingredients; and (d) drying the fabrics.

The detergent composition normally contains an anionic, nonionic, amphoteric or ampholytic surfactant or a mixture thereof, and frequently contains in addition an organic or inorganic builder. When multiple rinses are used, the fabric conditioning composition is preferably added to the final rinse. Fabric drying can take place either in the open air or in an automatic dryer.

The following examples illustrate the invention.

In the Examples, the following abbreviations are used:

| | |
|---|---|
| Ditallow* dimethyl ammonium chloride | DTDMAC |
| Didocosyl dimethyl ammonium chloride | DDDMAC |
| Dilauryl diethyl ammonium methosulfate | DLDEAM |
| Tallow* trimethyl ammonium chloride | MTTMAC |
| N—tallowyl-N,N'N'—tris(2-hydroxyethyl)-1,3-propane-diamine, dihydrochloride | MTHPD |
| Coconut alkyl trimethyl ammonium chloride | MCTMAC |
| Tritallow* methyl ammonium chloride | TTMAC |
| Glyceryl monostearate (40% monoester; 60% di- and triesters) | GMS |

*Represents hydrogenated tallow.

EXAMPLES I TO VI

Concentrated liquid fabric softeners are prepared having the following compositions.

| | Examples (wt %) | | | | | |
|---|---|---|---|---|---|---|
| | I | II | III | IV | V | VI |
| DTDMAC | — | 12 | — | 15 | 6 | 9 |
| DDDMAC | 11 | — | — | — | — | — |
| DLDEAM | — | — | 16 | — | 6 | — |
| MTTMAC | — | 1 | — | 1 | 1 | 0.5 |
| MTHPD | — | 1 | 1 | — | — | 1.5 |
| MCTMAC | 2 | — | — | 1.5 | — | — |
| GMS | 4 | 3 | 2 | 3 | 1 | 4 |
| Calcium chloride (ppm) | — | 800 | 500 | — | 600 | — |
| Magnesium sulfate (ppm) | 700 | — | — | 750 | — | 650 |
| Silicone DC-346 (Dow Corning) | 0.2 | — | — | 0.5 | — | — |
| EOPEI | 0.1 | — | — | 0.2 | — | — |
| Polyethylene glycol | — | — | 0.5 | — | — | 0.1 |
| Isopropanol | 2 | 4 | — | 1 | — | — |
| Perfume, dye, preservative and water | | | to 100 | | | |
| pH | | | 4.8–5.0 | | | |

The compositions are prepared by comelting the water-insoluble cationic fabric softener and the fatty acid ester at about 65° C. and slowly adding the melt to a warm (45° C.) water seat containing the water-soluble surfactant which is then stirred for about 20 minutes. After addition of minor ingredients and electrolyte, the compositions are then cooled and finally perfume is added.

The products thus prepared are stable dispersions displaying excellent viscosity characteristics at both low and high temperatures over prolonged periods of storage; they deliver excellent softening and antistatic performance across the range of natural and synthetic fabrics, and they also display excellent dispensing and dissolving characteristics in cold rinse water.

EXAMPLES VII TO XI

Additional liquid textile treatment compositions are prepared as follows. The cationic fabric softener, water-soluble surfactant and fatty acid ester are melted together at about 65° C. The comelt at a temperature of about 65° C. is then added to a warm (45° C.) water seat containing the minor ingredients and the mixture stirred for about 20 minutes. The electrolyte is subsequently added to the warm mixture. The final pH is about 3 to 4.

| | Examples | | | | |
|---|---|---|---|---|---|
| | VII | VIII | IX | X | XI |
| DTDMAC | 14 | 12 | — | 4 | 9 |
| MTTMAC | 0.4 | 0.6 | — | 0.2 | — |
| TTMAC | 0.6 | 0.6 | — | 0.2 | — |
| DDDMAC | — | — | 13 | 8 | 4 |
| MTHPD | 1.2 | 1.0 | 0.6 | 0.8 | 0.5 |
| GMS | 2.5 | 3 | 3.5 | 2.0 | 1.8 |
| Calcium chloride (ppm) | 650 | 700 | 700 | 800 | 950 |
| Sodium chloride (ppm) | 300 | 200 | — | 100 | — |
| Polyethylene glycol (6,000–8,000 m. wt) | 2 | 0.5 | — | — | 1.5 |
| Isopropanol | 3 | 0.7 | 1.2 | 0.9 | 1.0 |
| Perfume, dye, preservatives and water | | | to 100 | | |

The above products display excellent softening characteristics on both natural and synthetic fabrics, low viscosity at both normal and elevated temperatures, and good product stability and dispersability, compared with compositions containing no alkoxylated ammonium surfactant.

What we claim is:

1. An aqueous textile treatment composition from about 12% to about 25% of an active mixture consisting essentially of (a) from about 8% to about 22% of a substantially water-insoluble cationic fabric softener having the general formula I

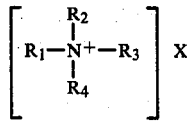

I wherein $R_1$ and $R_2$ are independently selected from the group consisting of alkyl and alkenyl groups having from about 12 to about 24 carbon atoms. $R_3$ and $R_4$ are independently selected from the group consisting of hydrogen, alkyl, alkenyl and hydroxyalkyl groups containing from about 1 to about 4 carbon atoms; and X is an equivalent amount of a counteranion, (b) from about 0.6% to about 3% of water-soluble surfactant comprising apolyalkoxylated ammonium salt having the general formula II

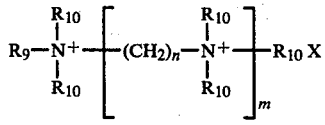

II wherein $R_9$ is selected from the group consisting of alkyl and alkenyl groups of from about 8 to about 22 carbon atoms, and each $R_{10}$ is independently selected from the group consisting of $C_1$–$C_4$ alkyl, $-(C_2H_4O)_pH$, $-(C_3H_6O)_qH$ and $-(C_2H_4O)_r(C_3H_6O)_sH$; wherein n is an integer from 2 to about 6; m is an integer from 1 to about 5; p,q,r,s, are each a number average in the range from 0 to about 14, the sum total of p,q,r, and s in the molecule being from 2 to about 14, X is an equivalent amount of a counteranion and (c) from about 0.2% to about 5% of a fatty acid ester of a polyhydric alcohol, the ester having a total of from about 10 to about 40 carbon atoms and at least one free hydroxy group per molecule.

2. A composition according to claim 1 comprising from about 1% to about 3% of water-soluble cationic surfactant wherein the weight ratio of cationic fabric softener:water soluble surfactant is less than or equal to about 8:1.

3. A composition according to claim 1 or 2 wherein the water-soluble cationic surfactant comprises a mixture of the polyalkoxylated ammonium salt of formula II and a non-alkoxylated ammonium salt having the general formula III

III

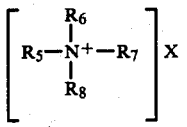

wherein $R_5$ is selected from the group consisting of alkyl or alkenyl groups containing from about 8 to about 24 carbon atoms; $R_6$, $R_7$, and $R_8$ are independently selected from the group consisting of alkyl or alkenyl groups containing from 1 to 4 carbon atoms; and X is as defined above.

4. A composition according to claim 3 wherein the water-soluble cationic surfactant is a mixture of nonalkoyxlated ammonium salt and polyalkoxylated ammonium salt in a weight ratio of from about 10:1 to about 1:6.

5. A composition according to claim 1 wherein the water-soluble surfactant comprises from about 1.4% to about 2.5% by weight of the composition.

6. A composition according to claim 1 comprising from about 0.4% to about 1.5% of the polyalkoxylated ammonium surfactant.

7. A composition according to claim 1 comprising from about 1% to about 4% of the fatty acid ester.

8. An aqueous textile treatment composition consisting essentially of:

(a) from about 8% to about 18% of a substantially water-insoluble cationic fabric softener having the general formula I (b) from about 0.4% to about 1.5% of water-soluble surfactant comprising a polyalkoxylated ammonium salt having the general formula II (c) from about 0.2% to about 2% of water soluble cationic surfactant having the general formula III, and (d) from about 0.2% to about 5% of a fatty acid ester of a polyhydric alcohol, the ester having a total of from about 10 to about 40 carbon atoms and at least one free hydroxy group per molecule.

9. A composition according to claim 8 wherein the fatty acid ester is glyceryl monostearate.

10. A composition according to claim 1 further including a component selected from the group consisting of:

(a) from about 50 to about 1500 parts per million of electrolyte, (b) from about 0.1% to about 5% of polyethyleneglycol having an average molecular weight in the range from about 1000 to about 40,000, and (c) from about 0.2% to about 4% of isopropanol, the weight ratio of cationic fabric softener to isopropanol lying in the range from about 50:1 to about 6:1, and (d) mixtures of any of the foregoing.

11. A composition according to claim 9 further including a component selected from the group consisting of:

(a) from about 50 to about 1500 parts per million of electrolyte, (b) from about 0.1% to about 5% of polyethyleneglycol having an average molecular weight in the range from about 1000 to about 40,000, and (c) from about 0.2% to about 4% of isopropanol, the weight ratio of cationic fabric softener to isopropanol lying in the range from about 50:1 to about 6:1, preferably from about 25:1 to about 12:1, and (d) mixtures of any of the foregoing.

12. A method of making a textile treatment composition of claim 1 wherein the process comprises the steps of (a) preparing a molten premix of the water-insoluble cationic fabric softener, fatty acid ester, and water-soluble surfactant, (b) intimately mixing the molten premix with n aqueous medium at a temperature above the melting point of the premix to form an aqueous dispersion, and (c) cooling the dispersion.

13. The composition of claim 10 wherein the level of electrolyte is within the range of from about 600 to about 1000 parts per million, the level of polyethyleneglycol is within the range of from about 0.3% to about 2%, and the level of isopropanol is within the range of from about 0.5% to about 2%.

14. The composition of claim 11 wherein the level of electrolyte is within the range of from about 600 to about 1000 parts per million, the level of polyethyleneglycol is within the range of from about 0.3% to about 2%, and the level of isopropanol is within the range of from about 0.5% to about 2%.

* * * * *